US006875009B2

(12) United States Patent
Kayahara et al.

(10) Patent No.: US 6,875,009 B2
(45) Date of Patent: Apr. 5, 2005

(54) COMBUSTION METHOD AND APPARATUS FOR $NO_X$ REDUCTION

(75) Inventors: Toshihiro Kayahara, Matsuyama (JP); Noboru Takubo, Matsuyama (JP)

(73) Assignee: Miura Co., Ltd., Ehime-ken (JP)

( * ) Notice: Subject to any disclaimer, the term of this patent is extended or adjusted under 35 U.S.C. 154(b) by 0 days.

(21) Appl. No.: 10/622,489

(22) Filed: Jul. 21, 2003

(65) Prior Publication Data

US 2004/0072110 A1 Apr. 15, 2004

(30) Foreign Application Priority Data

Jul. 29, 2002 (JP) ..... 2002-219397
May 20, 2003 (JP) ..... 2003-141253

(51) Int. Cl.[7] ..... F23M 3/00
(52) U.S. Cl. ..... 431/9; 431/12; 431/115
(58) Field of Search ..... 431/8, 9, 10, 115, 431/116, 350, 351, 354, 181, 174, 187, 12

(56) References Cited

U.S. PATENT DOCUMENTS 5,201,650 A * 4/1993 Johnson ..... 431/9
5,353,748 A 10/1994 Kayahara et al.
6,029,614 A 2/2000 Kayahara et al.
6,383,461 B1 * 5/2002 Lang ..... 423/235
6,705,855 B2 * 3/2004 Nagayama et al. ..... 431/12

* cited by examiner

*Primary Examiner*—James C. Yeung
(74) *Attorney, Agent, or Firm*—Birch, Stewart, Kolasch & Birch, LLP

(57) ABSTRACT

Combustion method and apparatus for $NO_x$ reduction and CO reduction which are capable of easily achieving super $NO_x$ reduction with the value of exhaust $NO_x$ under 10 ppm. The combustion method for $NO_x$ reduction by controlling the temperature of combustion gas derived from a burner includes in combination the steps of suppressing combustion gas temperature by heat absorbers; suppressing the combustion gas temperature by recirculating burning-completed gas to a combustion-gas burning reaction zone; and suppressing the combustion gas temperature by adding water or steam to combustion-use air of the burner, whereby the temperature of the combustion gas derived from the burner is suppressed.

16 Claims, 12 Drawing Sheets

COMBUSTION METHOD AND APPARATUS FOR $NO_X$ REDUCTION

This nonprovisional application claims priority under 35 U.S.C. §119 (a) on Patent Application No.(s). 2002-219397 filed in Japan on Jul. 29, 2002 and 2003-141253 filed in Japan on May 20, 2003, which is (are) herein incorporated by reference.

BACKGROUND OF THE INVENTION

The present invention relates to a combustion method for $NO_x$ reduction, as well as an apparatus therefor, to be applied to water-tube boilers, reheaters of absorption refrigerators, or the like.

Generally, as the principle of suppression of $NO_x$ generation, there have been known (1) suppressing the temperature of flame (combustion gas), (2) reduction of residence time of high-temperature combustion gas, and (3) lowering the oxygen partial pressure. Then, various $NO_x$ reduction techniques to which these principles are applied are available. Examples that have been proposed and developed into practical use include the two-stage combustion method, the thick and thin fuel combustion method, the exhaust gas recirculate combustion method, the water addition combustion method, the steam jet combustion method, the flame cooling combustion method with water-tube groups, and the like.

With the progress of times, $NO_x$ generation sources even of relatively small capacity such as water-tube boilers have been coming under increasingly stricter regulation of exhaust gas, and so further reduction of $NO_x$ are demanded therefor. The present applicant proposed a $NO_x$ reduction technique for these demands by Japanese Patent Laid-Open Publication HEI 11-132404 (Specification of U.S. Pat. No. 6,029,614).

This prior art technique is intended to achieve $NO_x$ reduction by a combination of suppression of combustion gas temperature with water tubes and suppression of combustion gas temperature with exhaust gas recirculation. However, the technique was capable of $NO_x$ reduction up to only about 25 ppm, other than one that allows $NO_x$ reduction to below 10 ppm to be achieved. It is noted that $NO_x$ reduction with the value of $NO_x$ generation being not more than 10 ppm will hereinafter be referred to as super $NO_x$ reduction.

In this prior art technique, it is conceivable to enhance the function of combustion-gas-temperature suppression with water tubes with the aim of achieving the super $NO_x$ reduction. This functional enhancement is to provide water tubes in contact with a burner or to increase the heat transfer surface of water tubes. However, excessive fulfilment of this functional enhancement would cause an increase in pressure loss or an unstable combustion such as oscillating combustion.

Further, it is also conceivable to enhance the function of combustion-gas-temperature suppression with exhaust gas recirculation to achieve the super $NO_x$ reduction. This functional enhancement is to increase the exhaust-gas recirculation quantity. However, this functional enhancement would cause an amplification of unstable characteristics of exhaust gas recirculation. That is, the exhaust gas recirculation has a characteristic that exhaust-gas flow rate or temperature changes due to changes in combustion quantity or changes in load. Increasing the exhaust-gas recirculation rate would cause these unstable characteristics to be amplified, so that stable $NO_x$ reduction could not be achieved.

Furthermore, the functional enhancement for exhaust gas recirculation would cause the combustion reaction to be suppressed, which would lead to an increase in emission of CO and unburnt components as well as to an increase in thermal loss. Also, increasing the exhaust gas recirculation rate would cause the blower load to increase. Excessive suppression of burning reaction would lead to an increase in emission of CO and unburnt contents, as well as to an increase in thermal loss.

SUMMARY OF THE INVENTION

An object of the present invention is to provide a combustion method for $NO_x$ reduction, as well as an apparatus therefor, capable of easily achieving $NO_x$ reduction with the value of exhaust $NO_x$ under 10 ppm.

The present invention having been accomplished to solve the above object, in a first aspect of the invention, there is provided a $NO_x$ reduction combustion method for fulfilling $NO_x$ reduction by controlling temperature of combustion gas derived from a burner, comprising in combination the steps of: suppressing combustion gas temperature by heat absorbers; suppressing combustion gas temperature by recirculating burning-completed gas to a combustion-gas burning reaction zone; and suppressing combustion gas temperature by adding water or steam to combustion-use air of the burner, whereby the combustion gas temperature is suppressed.

In one embodiment, there is provided a $NO_x$ reduction combustion method as described in the first aspect, further comprising in combination the step of suppressing combustion gas temperature by burning the burner as a fully-premixing type burner at a high excess air ratio.

In a second aspect of the invention, there is provided a combustion apparatus for $NO_x$ reduction for fulfilling $NO_x$ reduction by controlling temperature of combustion gas derived from a burner, comprising: first suppression means for suppressing combustion gas temperature by heat absorbers provided in a burning reaction zone; second suppression means for suppressing combustion gas temperature by recirculating burning-completed gas to the combustion-gas burning reaction zone; and third suppression means for suppressing combustion gas temperature by adding water or steam to combustion-use air of the burner.

Further, in one embodiment, there is provided a combustion apparatus for $NO_x$ reduction as described in the second aspect, further comprising, in combination, fourth suppression means for suppressing combustion gas temperature by burning the burner as a fully-premixing type burner at a high excess air ratio.

Before the description of the embodiments of the present invention, terms used herein and the drawings are explained. The combustion gas includes burning-reaction ongoing (under-combustion-process) combustion gas, and combustion gas that has completed burning reaction. Then, the burning-reaction ongoing gas refers to combustion gas that is under burning reaction, and the burning-completed gas refers to combustion gas that has completely burning-reacted. The burning-reaction ongoing gas is indeed a concept of substance, but can also be referred to as flame as a concept of state because it generally includes a visible flame so as to be in a flame state. Therefore, herein, the burning-reaction ongoing gas is referred to also as flame or burning flame from time to time. Further, the exhaust gas (flue gas) refers to burning-completed gas that has decreased in temperature under an effect of endothermic action by heat transfer tubes or the like.

Also, the combustion gas temperature, unless otherwise specified, means the temperature of burning-reaction ongoing gas, equivalent to combustion temperature or combustion flame temperature. Further, the suppression of combustion gas temperature refers to suppressing the maximum value of combustion gas (combustion flame) temperature to a low one. In addition, normally, burning reaction is continuing although in a trace amount even in the burning-completed gas, and so the combustion completion does not mean a 100% completion of burning reaction.

Further, the excess air ratio, which is expressed as (actual amount of combustion air)/(theoretical amount of combustion air), corresponds in a specified relationship to exhaust-gas $O_2$(%) (oxygen concentration in exhaust gas), therefore being expressed in exhaust-gas $O_2$(%). Also, the value of $NO_x$ shows a value at 0% $O_2$ in the exhaust gas, dry basis, while the value of CO shows not an equivalent value but a reading value.

Next, as a detailed description of the foregoing characteristics of the present invention, embodiments of the present invention are described. The present invention is applied to thermal equipment (or combustion equipment) such as small-size once-through boilers or other water-tube boilers, water heaters, reheaters of absorption refrigerators or the like. The thermal equipment has a burner and a group of heat absorbers to be heated by combustion gas derived from the burner.

An embodiment of the method according to the present invention is a $NO_x$ reduction combustion method for fulfilling $NO_x$ reduction by suppressing temperature of combustion gas derived from a burner by a $NO_x$ reduction means implemented by a combination of: suppression means for suppressing combustion gas temperature by heat absorbers (hereinafter, referred to as "first suppression means"); suppression means for suppressing combustion gas temperature by recirculating burning-completed gas to a combustion-gas burning reaction zone (hereinafter, referred to as "second suppression means"); and suppression means for suppressing combustion gas temperature by adding water or steam (hereinafter, referred to as "water/steam addition") to combustion-use air of the burner (hereinafter, referred to as "third suppression means"). The $NO_x$ reduction means is so designed as to reduce the generated $NO_x$ value to not more than 10 ppm, which is a $NO_x$ reduction target value, at not less than a specified excess air ratio.

The first suppression means forming part of the $NO_x$ reduction means is based on the following principle. That is, the $NO_x$ value is reduced by suppressing the combustion gas temperature by a cooling effect of heat absorbers implemented by arranging a multiplicity of heat absorbers in the burning-reaction ongoing gas derived from the burner, i.e., in the burning reaction zone. This first suppression means is implemented by arranging the heat absorbers to cool the burning-reaction ongoing gas, hence a nonuniform cooling. There are also sites where the burning is ongoing actively in the gaps between the heat absorbers of the burning reaction zone. Particularly in the downstream of the heat absorbers, eddy currents are formed so that the combustion flame is stabilized by the heat transfer tubes. The heat absorbers are implemented by heat absorbers such as water tubes, but this is not limitative.

The arrangement configuration as to how the heat absorbers are arranged with respect to the flow of the burning-reaction ongoing gas, includes the following two modes. One of those arrangement configurations is that a combustion gas passage is formed so as to allow combustion gas to flow generally linearly therethrough from the burner to the exhaust gas outlet, and moreover the heat absorbers are arranged so as to cross the burning-reaction ongoing gas derived from the burner with gaps present among the heat absorbers to allow the combustion gas to flow therethrough. The other arrangement configuration is that heat absorbers are arrayed in an annular state with gaps present thereamong to allow the combustion gas to flow therethrough, so that the combustion gas derived from the burner flows radially from the inside of the annular heat absorbers toward the heat absorbers, where the heat absorbers are arranged in the burning-reaction ongoing gas derived from the burner. The latter configuration is described in detail in Japanese Patent Laid-Open Publication HEI 11-132404 (U.S. Pat. No. 6,029,614), the disclosure of which is hereby incorporated by reference.

The second suppression means is what is called exhaust-gas recirculation combustion method. Exhaust gas which has decreased in temperature through endothermic action by the heat absorbers and is then to be emitted to the atmosphere is partly mixed with combustion-use air via an exhaust-gas recirculation passage. The combustion gas temperature is suppressed by a cooling effect of the mixed exhaust gas, by which $NO_x$ value is reduced. This second suppression means exerts uniform cooling of combustion gas.

The third suppression means is water/steam addition to the burning reaction zone. By this water/steam addition, the burning-reaction ongoing gas is cooled, so that the combustion gas temperature is suppressed and the $NO_x$ value is reduced. This third suppression means also exerts uniform cooling of the combustion gas. The water/steam addition may be carried out in the exhaust-gas recirculation passage in another embodiment. Besides, in an embodiment in which the burner is provided as a fully-premixing type gas burner and mixed gas of combustion-use air and exhaust gas is fed to the burner by a blower, it is possible to perform the steam addition between the burner and the blower. For the water addition, water is added in the form of mist.

Working effects by the combination of the first to third suppression means are as follows. Enhancing the combustion-gas-temperature suppression functions of the first suppression means and the second suppression means would cause drawbacks of the respective suppression means to matter. However, combining the three suppression means makes it possible to achieve super $NO_x$ reduction relatively easily without causing the emergence of those drawbacks. In particular, by combining the third suppression means, unstable characteristics of the second suppression means can be alleviated, producing a working effect that stable super $NO_x$ reduction can be achieved.

In this embodiment, preferably, suppression of combustion gas temperature by burning the burner as a fully-premixing type burner at a high excess air ratio (hereinafter, referred to as fourth suppression means) may be combined. The fourth suppression means is based on the following principle. That is, when the burner is burned at a high excess air ratio, the combustion gas temperature is suppressed so that the $NO_x$ value decreases. The high excess air ratio in this case is 5% $O_2$ or more contained in exhaust gas, preferably, not less than 5.5% $O_2$. This suppression effect acts generally uniformly on the entire burning reaction zone formed by the burner.

By combining this fourth suppression means, the problems due to the functional enhancement of the foregoing individual suppression means can be further alleviated.

Furthermore, in the foregoing embodiment, preferably, an excess-air-ratio control means for controlling the excess air ratio to a specified high excess air ratio is additionally provided. More specifically, an oxygen concentration detection means for detecting the oxygen concentration in exhaust gas is provided, and the rotational speed of the blower for blowing combustion-use air to the burner is controlled so that the oxygen concentration detected by the oxygen concentration detection means becomes a set value corresponding to the specified high excess air ratio. The specified high excess air ratio is determined in the following manner. Given a $NO_x$ reduction target value of 10 ppm, an excess air ratio corresponding to the target value is determined under the condition of the excess air ratio versus $NO_x$ characteristic of the $NO_x$ reduction means, and then the excess air ratio determined in this way or a value higher than the excess air ratio is taken as a specified high excess air ratio. Finally, the specified high excess air ratio corresponds to the $NO_x$ reduction target value.

Further, the excess-air-ratio control means includes the following modifications. The foregoing excess-air-ratio control means is designed to control the rotational speed of the blower. Instead, the excess-air-ratio control means may be designed to control the opening of a combustion-use-air flow rate adjusting means such as a damper or a valve provided downstream or upstream of the blower so that the excess air ratio is controlled constant. Further, in another embodiment, it is also possible that an outside-air temperature detection means for detecting outside-air temperature is provided in place of the oxygen concentration detection means, where the blower or the flow rate adjusting mechanism is controlled by this outside-air temperature detection means so that the excess air ratio is controlled constant.

Next, embodiments of the apparatus of the present invention are described. The present invention includes the following embodiments (1) to (2) of the apparatus corresponding to the foregoing embodiments.

Embodiment (1): A combustion apparatus for $NO_x$ reduction by controlling temperature of combustion gas derived from a burner, wherein $NO_x$ reduction means is made up of the first suppression means, the second suppression means and the third suppression means.

Embodiment (2): A combustion apparatus for $NO_x$ reduction, in which the $NO_x$ reduction means further includes the fourth suppression means.

Furthermore, the embodiments of the apparatus further include the following embodiments (3) to (7).

Embodiment (3): A combustion apparatus for $NO_x$ reduction as defined in the first embodiment (1), comprising: $NO_x$ reduction means having an excess air ratio versus $NO_x$ characteristic that generated $NO_x$ value decreases with increasing excess air ratio of the burner, as well as an excess air ratio versus CO characteristic that exhaust CO value increases with increasing excess air ratio; and excess-air-ratio control means for controlling the excess air ratio of the burner to a specified high excess air ratio, wherein the specified excess air ratio is determined from the excess air ratio versus $NO_x$ characteristic and a $NO_x$ reduction target value.

Embodiment (4): A combustion apparatus for $NO_x$ reduction as defined in the embodiment (2), comprising: $NO_x$ reduction means having an excess air ratio versus $NO_x$ characteristic that generated $NO_x$ value decreases with increasing excess air ratio of the burner, as well as an excess air ratio versus CO characteristic that exhaust CO value increases with increasing excess air ratio; and excess-air-ratio control means for controlling the excess air ratio of the burner to a specified high excess air ratio, wherein the specified excess air ratio is determined from the excess air ratio versus $NO_x$ characteristic and a $NO_x$ reduction target value.

According to the foregoing embodiments (3) to (4), a stable super $NO_x$ reduction can be achieved by the control of the excess air ratio even with the outside-air temperature varied.

Embodiment (5): A combustion apparatus for $NO_x$ reduction and CO reduction as defined in the foregoing embodiment (1), wherein the burner is switchable between high combustion and low combustion, and wherein combustion gas temperature is suppressed by the first suppression means, the second suppression means and the third suppression means in both high combustion state and low combustion state, and the exhaust-gas recirculation quantity by the second suppression means as well as the water/steam addition quantity by the third suppression means are controlled between the low combustion state and the high combustion state.

According to this embodiment (5), since the exhaust-gas recirculation quantity and the water/steam addition quantity are controlled in accordance with increases or decreases of combustion quantity, there can be provided a working effect that the problems that would be caused by enhancing the function of only either one of the second suppression means or the third suppression means can be solved or alleviated.

Embodiment (6): A combustion apparatus for $NO_x$ reduction and CO reduction as defined in the foregoing embodiment (1), wherein the burner is switchable between high combustion and low combustion, and wherein combustion gas temperature is suppressed by the first suppression means and the second suppression means in the low combustion state, and combustion gas temperature is suppressed by the first suppression means, the second suppression means and the third suppression means in the high combustion state, and wherein exhaust-gas recirculation quantity by the second suppression means is kept unchanged between the low combustion state and the high combustion state.

Embodiment (7): A combustion apparatus for $NO_x$ reduction and CO reduction as defined in the foregoing embodiment (1), wherein the burner is switchable between high combustion and low combustion, and wherein combustion gas temperature is suppressed by the first suppression means and the second suppression means in both low combustion state and high combustion state, and wherein exhaust-gas recirculation quantity by the second suppression means is kept unchanged between the low combustion state and the high combustion state while water/steam addition quantity by the third suppression means in the high combustion state is set larger than that of the low combustion state.

These embodiments (6) and (7) are so constituted that the exhaust-gas recirculation quantity are kept unchanged between low combustion state and high combustion state, that is, the exhaust-gas recirculation quantity is not controlled but kept unchanged therebetween, while the water/steam addition quantity is controlled between high combustion state and low combustion state. As a result, there can be provided working effects that the exhaust-gas recirculation quantity adjusting means that would otherwise be involved for the switching between high combustion and low combustion is no longer necessary, and that unstable characteristics of exhaust gas recirculation upon increasing the exhaust-gas recirculation quantity can be alleviated.

DETAILED DESCRIPTION OF THE PREFERRED EMBODIMENTS

Figure 1:
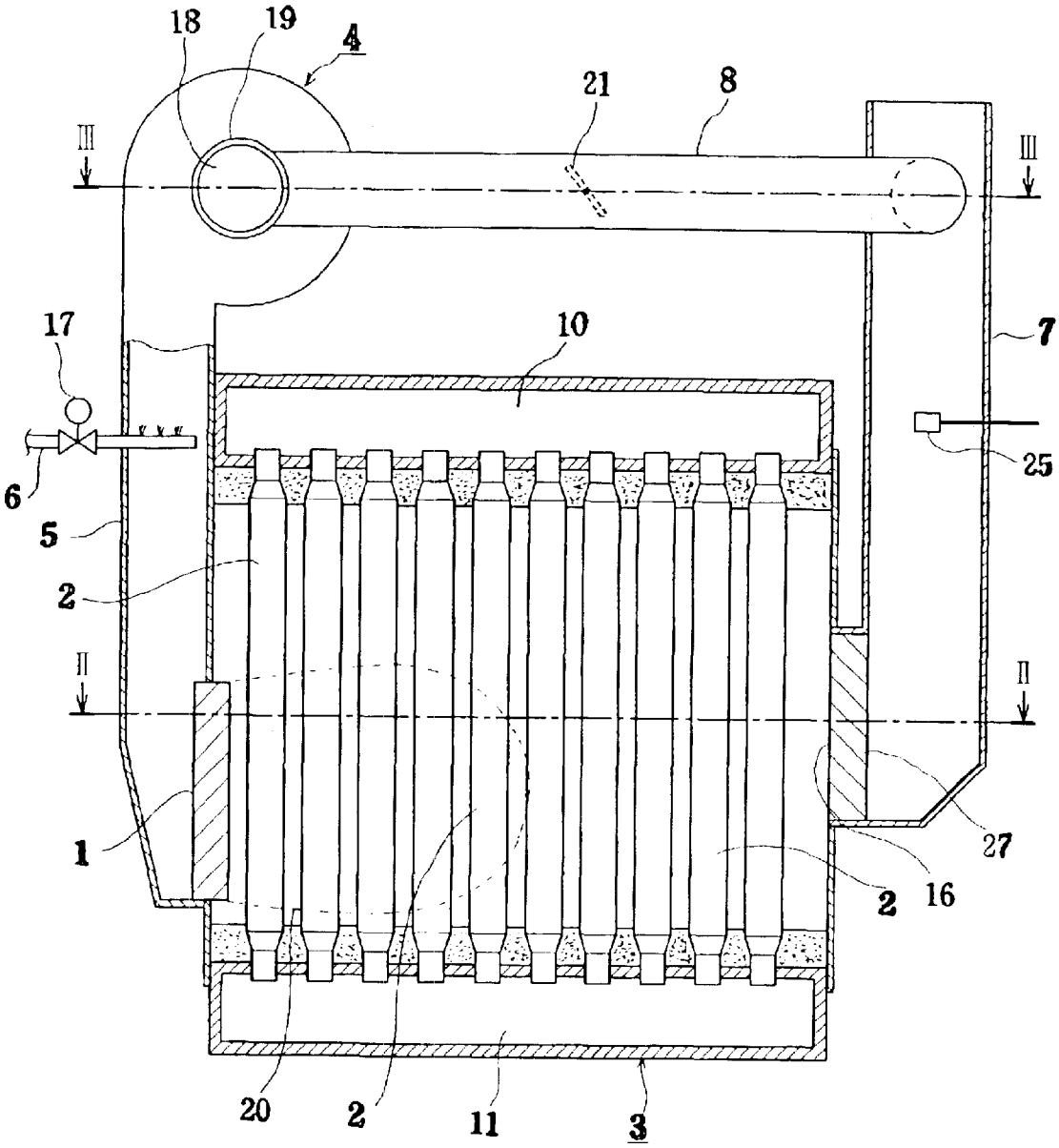
FIG. 1 is an explanatory view of a longitudinal section of a steam boiler of an embodiment of the present invention.
Figure 2:
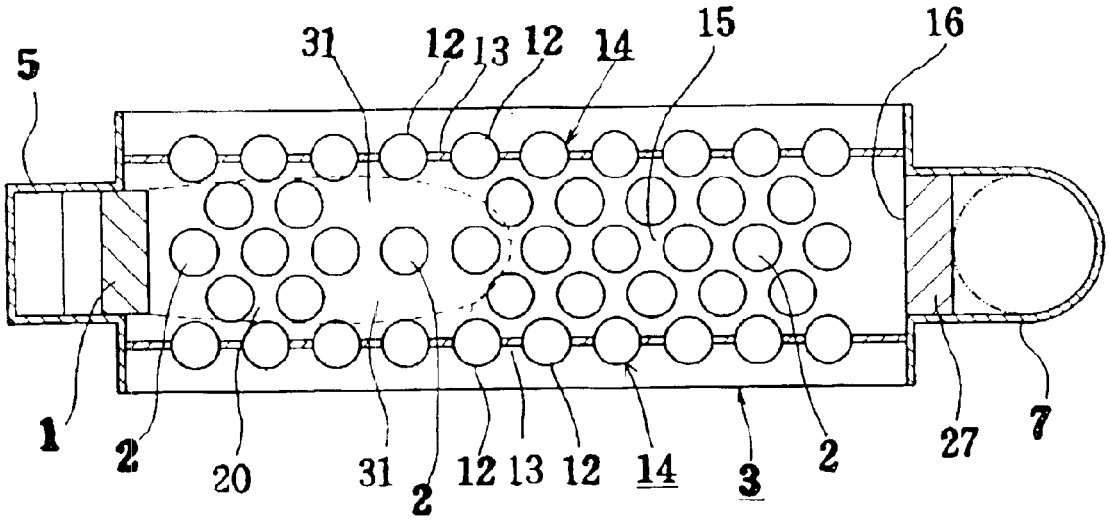
FIG. 2 is a sectional explanatory view of the same embodiment taken along the line II—II of FIG. 1.
Figure 3:
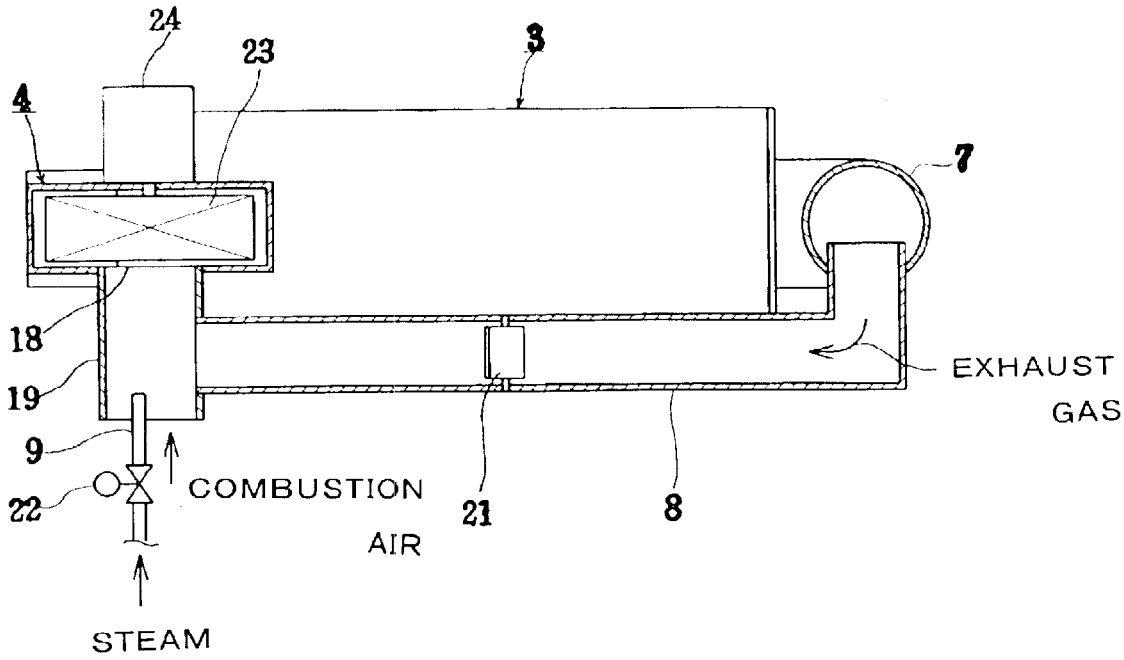
FIG. 3 is a cross-sectional explanatory view of the same embodiment taken along the line III—III of FIG. 2.
Figure 4:
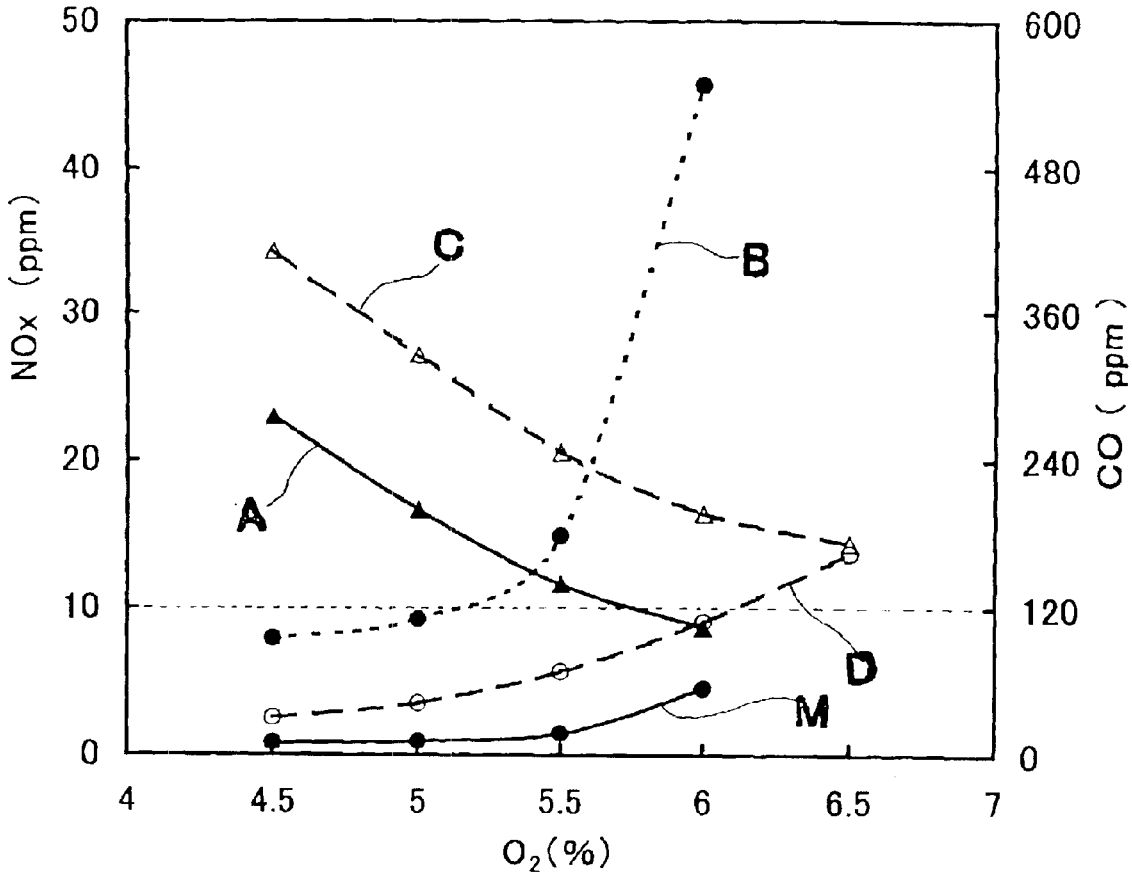
FIG. 4 is a chart showing excess air ratio versus $NO_x$ characteristic ($NO_x$ emission characteristic) curves, and excess air ratio versus CO characteristic (CO emission characteristic) curves in high combustion state of the same embodiment.
Figure 5:
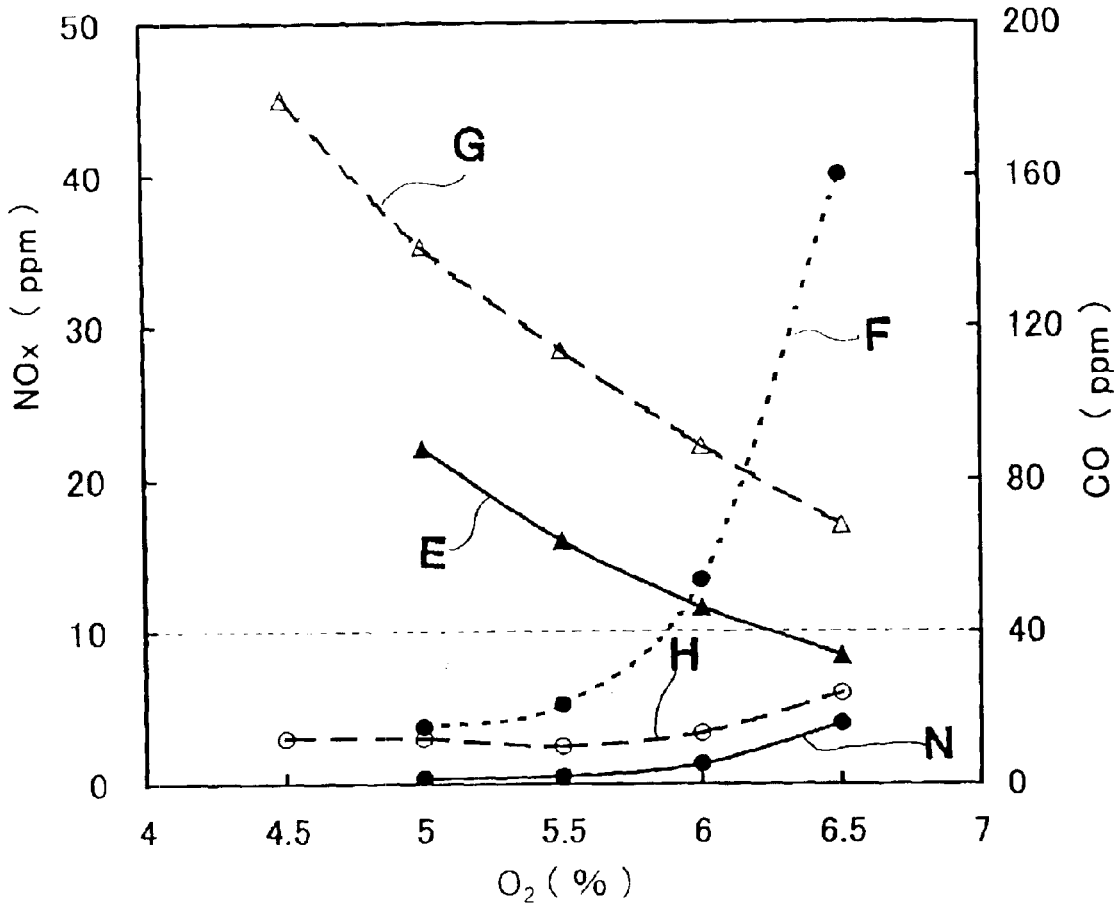
FIG. 5 is a chart showing excess air ratio versus $NO_x$ characteristic curves, and excess air ratio versus CO characteristic curves in low combustion state of the same embodiment.
Figure 6:
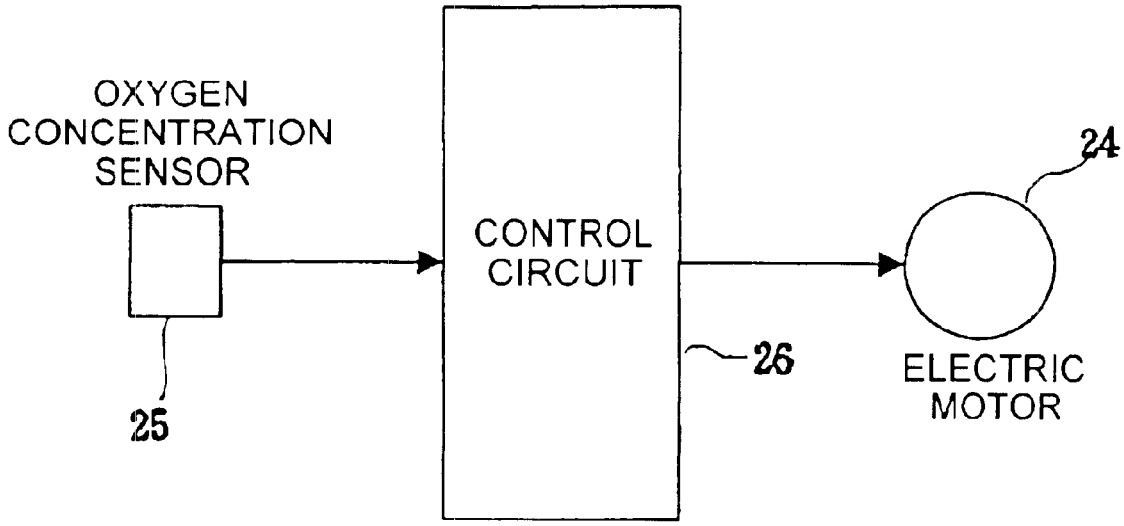
FIG. 6 is a main-part control circuit diagram of the same embodiment.
Figure 7:
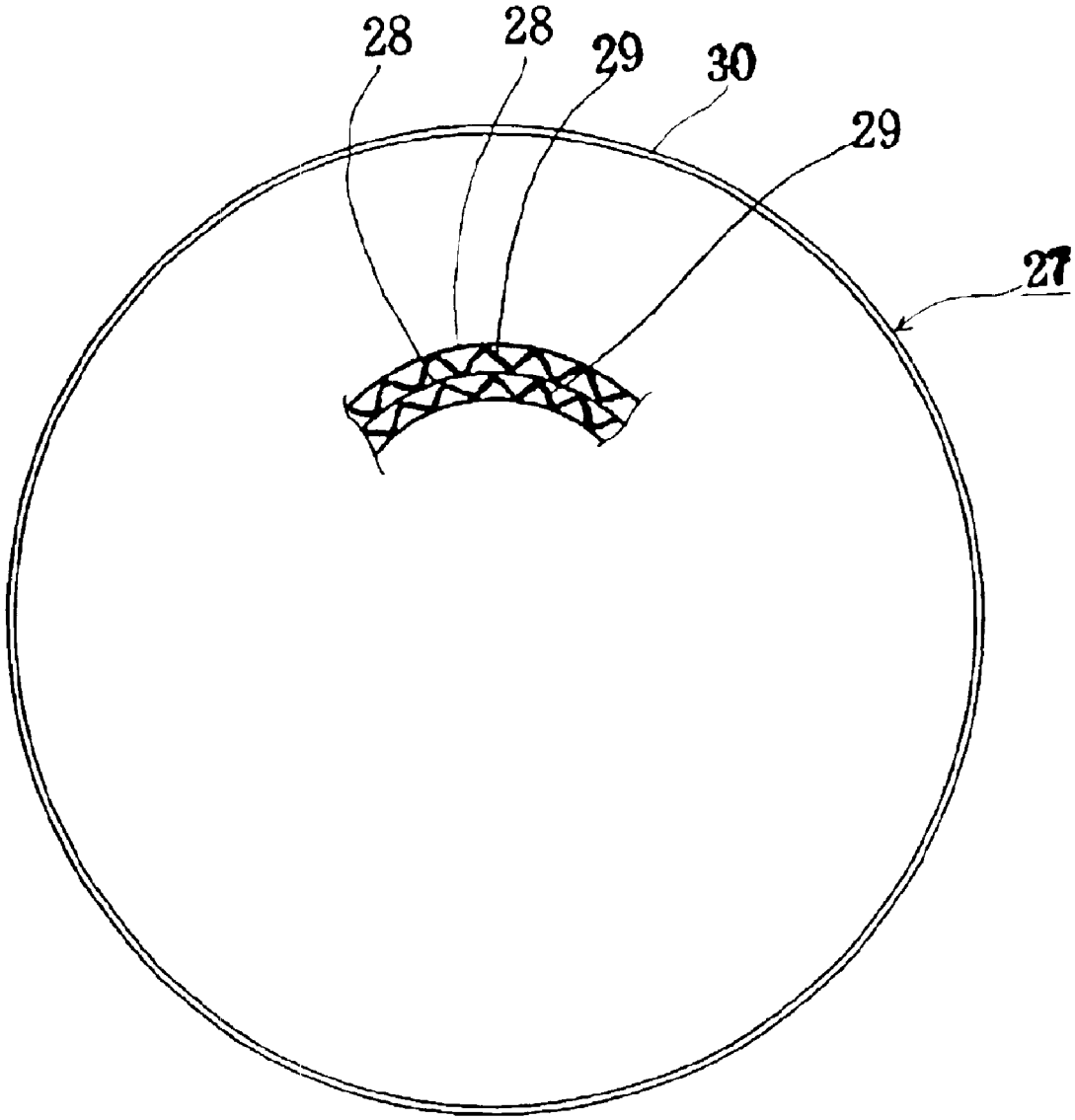
FIG. 7 is a front view showing a main-part constitution of a CO oxidation catalyst member in the same embodiment.

Hereinbelow, working examples in which the $NO_x$ reduction combustion method and apparatus of the present invention are applied to a once-through steam boiler, which is one type of water-tube boilers, are described in accordance with the accompanying drawings. FIG. 1 is an explanatory view of a longitudinal section of a steam boiler to which an embodiment of the present invention is applied, FIG. 2 is a sectional view taken along the line II—II of FIG. 1, FIG. 3 is a cross-sectional view taken along the line III—III of FIG. 1, FIGS. 4 and 5 are charts showing excess air ratio versus $NO_x$ characteristic as well as excess air ratio versus CO characteristic in high combustion state and low combustion state, respectively, in the same embodiment, FIG. 6 is a main-part control circuit diagram of the same embodiment, and FIG. 7 is a view showing a main-part constitution of a CO oxidation catalyst member in the same embodiment, as viewed along the direction of the exhaust gas flow.

Now the overall construction of the boiler according to this embodiment is explained below, and then the construction of its characteristic parts is explained. The characteristic parts include: $NO_x$ reduction means made up by a combination of a combustion-gas-temperature suppression for doing the suppression by a multiplicity of heat transfer tubes (first suppression means), a combustion-gas-temperature suppression means for doing the suppression by recirculating burning-completed gas to a burning reaction zone (second suppression means), a combustion-gas-temperature suppression means for doing the suppression by addition of steam to the burning reaction zone (third suppression means), and a combustion-gas-temperature suppression means for doing the suppression by burning a fully-premixing type burner at a high excess air ratio (fourth suppression means); and an excess-air-ratio control means for controlling the excess air ratio of the burner to maintain it at a specified high excess air ratio.

First, the overall construction of the steam boiler is explained. This steam boiler is switchable between operations at high combustion and low combustion. Then, the steam boiler comprises: a boiler body 3 having a fully-premixing type burner 1 having a planar burning surface (jet-out surface for premixed gas and a multiplicity of endothermic-use heat transfer tubes 2, 2, . . . ; a blower 4 and an air supply passage 5 for feeding combustion-use air to the burner 1; a gas fuel supply tube 6; an exhaust gas passage (normally referred to as flue) 7 for discharging exhaust gas exhausted from the boiler body 3; an exhaust-gas recirculation passage 8 for mixing, into the combustion-use air, part of the exhaust gas that is circulating along the exhaust gas passage 7 to feed it to the burner 1; and a steam addition tube 9 (see FIG. 3) for adding steam to the combustion-use air. It is noted that the outer diameter of each of the heat transfer tubes 2 is 60.5 mm.

The boiler body 3 is provided with an upper header 10 and a lower header 11, and has a plurality of the heat transfer tubes 2 arranged between the two headers 10, 11. Referring to FIG. 2, a pair of water walls 14, 14 formed by coupling outer heat transfer tubes 12, 12, . . . to one another with coupling members 13, 13, . . . are provided on lengthwise both sides of the boiler body 3, so that a combustion gas passage 15 that allows burning-reaction ongoing gas and burning-completed gas derived from the burner 1 to pass generally linearly therethrough is formed between the two water walls 14, 14 and the upper header 10 and the lower header 11.

Next, conjunction relationships among the foregoing individual elements are explained. As shown in FIG. 1, the burner 1 is provided at one end of the combustion gas passage 15, and the exhaust gas passage 7 is connected to an exhaust gas outlet 16 located at the other end. The air supply passage 5 is connected to the burner 1, and the gas fuel supply tube 6 is connected to the air supply passage 5 so that fuel gas is jetted out into the air supply passage 5. The gas fuel supply tube 6 is provided with a first valve 17 as a fuel flow adjusting means for adjusting the fuel flow between high combustion and low combustion. On the air supply passage 5 is provided a throttle portion (not shown), which is so called venturi, for enhancing the mixability of the fuel gas and the combustion-use air, but the throttle portion may be omitted for reduction of pressure loss in another embodiment.

Further, as shown in FIG. 3, an air inlet passage 19 is connected to an inlet port 18 of the blower 4, and the exhaust-gas recirculation passage 8 is connected between the air inlet passage 19 and the exhaust gas passage 7. The steam addition tube 9 is inserted in the air inlet passage 19.

Operation of this steam boiler based on the above-described constitution is outlined below. In the air supply passage 5, combustion-use air (outside air) fed through the air inlet passage 19 is premixed with fuel gas fed through the gas fuel supply tube 6, and the resulting premixed gas is jetted out from the burner 1 into the boiler body 3. The premixed gas is ignited by an ignition means (not shown), thus burning. Burning-reaction ongoing gas generated along with this burning crosses with upstream-side heat transfer tubes 2 so as to be cooled, resulting in burning-completed gas, which exchanges heat with downstream-side heat transfer tubes 2 so that its heat is absorbed, thus resulting in exhaust gas. The resultant exhaust gas is discharged into the atmosphere through the exhaust gas passage 7. Then, part of the exhaust gas is fed to the burner 1 through the exhaust-gas recirculation passage 8, and used for suppression of combustion gas temperature.

Water in the individual heat transfer tubes 2 is heated by the heat exchange with the combustion gas, thereby changed into steam. This steam is fed from a steam extraction means (not shown), which is connected to the upper header 10, to steam-utilizing equipment (not shown), while part of the steam is fed to the steam addition tube 9 so as to be used for the cooling of the burning-reaction ongoing gas.

Next, the above-noted characteristic parts of this embodiment are explained. The $NO_x$ reduction means reduces the value of $NO_x$ generation to not more than 10 ppm at a specified excess air ratio or more. The first suppression means forming part of the $NO_x$ reduction means is explained. This first suppression means is so structured that a multiplicity of the heat transfer tubes 2 are arranged generally all over the burning reaction zone (a zone where the combustion gas temperature is not less than about 900° C.) 20 formed by the burner 1, with gaps present thereamong to allow the combustion gas to flow therethrough. The burning-reaction ongoing gas derived from the burner 1 is cooled by these heat transfer tubes 2. As a result of this cooling, the combustion gas temperature is suppressed, so that the value of $NO_x$ is lowered. The arrangement pitch of the heat transfer tubes 2, which affects the degree of cooling of the combustion gas, is determined in consideration of the amount of combustion per time, pressure loss and the like.

The second suppression means is an exhaust-gas recirculating means composed of the exhaust gas passage 7, the exhaust-gas recirculation passage 8, the air supply passage 5 and the burner 1. At a proper place within the exhaust-gas recirculation passage 8 is provided a first damper 21 as a gas flow rate adjusting means for adjusting the exhaust-gas recirculation quantity to a specified quantity. Mixing exhaust gas with the premixed gas fed to the burner 1 causes the combustion gas temperature to be suppressed, so that the value of $NO_x$ lowers. The ratio of the quantity of exhaust gas to be recirculated (exhaust-gas recirculation quantity) to the combustion-use air quantity (actual combustion air quantity) is adjusted by the first damper 21 so as to be unchanged between high state and low combustion state.

The third suppression means, as shown in FIG. 3, is composed of the steam addition tube 9, the air inlet passage 19, the blower 4, the air supply passage 5 and the burner 1. A counter-addition-side end of the steam addition tube 9 is connected to the upper header 10 via a second valve 22 serving as a steam flow rate adjusting means for adjusting the quantity of steam addition, so that steam generated by the steam boiler is utilized as it is. Between the second valve 22 and the upper header 10 is provided an orifice or other pressure reducing mechanism (not shown). The steam is mixed uniformly into the combustion-use air fed to the burner 1, and jetted out into the boiler body 3 generally uniformly from a multiplicity of premixed-gas nozzles (not shown) of the burner 1. As a result, an effective cooling of the expandedly formed premixed combustion flame is achieved.

Further, the fourth suppression means is so structured that the fully-premixing type burner 1 is burned at a high excess air ratio. When the burner 1 is burned at a high excess air ratio, the combustion gas temperature lowers, so that the value of $NO_x$ reduction lowers. The burner 1 is a longitudinally 60 cm, laterally 18 cm sized rectangular-shaped burner with the premixed-gas jet nozzles formed generally uniformly therein. Then, the burner 1 is implemented by a known one made up by alternately stacking a multiplicity of flat plates and wave plates (not shown either), for example.

The steam boiler of this working example, as stated before, is switchable between operations at high combustion and low combustion. Then, the $NO_x$ reduction means of this steam boiler has the excess air ratio versus $NO_x$ characteristics and the excess air ratio versus CO characteristics in high combustion state and low combustion state shown in FIGS. 4 and 5. These excess air ratio versus $NO_x$ characteristics and excess air ratio versus CO characteristics are explained below.

First, the excess air ratio versus $NO_x$ characteristic and the excess air ratio versus CO characteristic in the high combustion state are determined as shown by a curve A and a curve B, respectively, of FIG. 4 with the excess air ratio varied under the continued-combustion condition. These operating conditions are a fuel of LPG, a combustion rate of the burner 1 of 50 $Nm^3/h$ (combustion rate of the steam boiler at high combustion), an exhaust-gas recirculation rate of 4% (exhaust-gas recirculation quantity/actual combustion air quantity), and a steam addition amount of 17 kg/h. Then, the actual combustion air quantity and the exhaust-gas recirculation quantity at the exhaust-gas recirculation rate of 4% are 1669 $Nm^3/h$ and 67 $Nm^3/h$, respectively, at 6% $O_2$, for instance.

Varying the excess air ratio is implemented by varying the actual combustion air quantity. Varying the actual combustion air quantity is implemented by controlling the rotational speed of an electric motor 24 (see FIG. 3) that drives a fan 23 of the blower 4. It is noted that a curve C and a curve D in FIG. 4 represent an excess air ratio versus $NO_x$ characteristic and an excess air ratio versus CO characteristic of comparative examples in which the cooling by the second suppression means and the third suppression means is not performed, given for contrast to the curve A and the curve B of this working example.

The excess air ratio versus $NO_x$ characteristic in the high combustion state of the $NO_x$ reduction means is, as shown by the curve A, one that the $NO_x$ value decreases with increasing excess air ratio. Also, the excess air ratio versus CO characteristic is, as shown by the curve B, one that the exhaust CO value increases with increasing excess air ratio, in particular, the exhaust CO value abruptly increases at 5% $O_2$ or more. It is noted that the curve C and the curve D in FIG. 4 represent an excess air ratio versus $NO_x$ characteristic and an excess air ratio versus CO characteristic of comparative examples in which the suppressions of combustion gas temperature by the second suppression means and the third suppression means are not performed, given for contrast to the curve A and the curve B of this working example.

Next, the excess air ratio versus $NO_x$ characteristics and the excess air ratio versus CO characteristic in the low combustion state of the $NO_x$ reduction means are explained below. These characteristics are determined as shown by a curve E and a curve F, respectively, of FIG. 5 as in the case of the high combustion state. The operating conditions in the low combustion state are a fuel of LPG, a combustion rate of the burner of 25 $Nm^3/h$ (combustion rate of the steam boiler at low combustion), an exhaust-gas recirculation rate of 4% (exhaust-gas recirculation quantity/actual combustion air quantity), and a steam addition amount of 8.5 kg/h. Then, the actual combustion air quantity and the exhaust-gas recirculation quantity at the exhaust-gas recirculation rate of 4% are 834 $Nm^3/h$ and 33 $Nm^3/h$, respectively, at 6% $O_2$, for instance.

The excess air ratio versus $NO_x$ characteristic in the low combustion state of the $NO_x$ reduction means is, as shown by the curve E, also one that the $NO_x$ value decreases with increasing excess air ratio. Further, the excess air ratio versus CO characteristic is, as shown by the curve F, one that the exhaust CO value increases with increasing excess air ratio, in particular, the exhaust CO value abruptly increases at 5.5% $O_2$ or more. It is noted that a curve G and a curve H, in FIG. 5 represent an excess air ratio versus $NO_x$ characteristic and an excess air ratio versus CO characteristic of comparative examples in which the suppressions of combustion gas temperature by the second suppression means and the third suppression means are not performed.

The excess-air-ratio control means, as shown in FIG. 6, is composed of an oxygen concentration sensor 25 (see FIG. 1) provided on the exhaust gas passage 7 and serving as the oxygen concentration detection means, and a control circuit 26 to which an output of the oxygen concentration sensor 25 is inputted and which controls the rotational speed of the electric motor 24. The electric motor 24 is so designed as to be controllable in rotational speed by inverter control. By controlling the rotational speed of the fan 23 so that the excess air ratio of the burner 1 becomes a specified high excess air ratio (specified value), a specified $NO_x$ reduction effect is maintained against changes in outside air temperature.

In this working example, given a $NO_x$ reduction target value of 10 ppm, the specified value can be determined as 5.8% $O_2$ in the high combustion state from the curve A of FIG. 4 and the value of 10 ppm. Of course, an $O_2$ ratio of higher than 5.8% satisfies the reduction target value, and so the specified value may be set to, for example, 6%. For the low combustion state, the specified value can be determined as 6.25% $O_2$ from the curve E of FIG. 5 and the value of 10 ppm.

In this working example, there is provided a CO reduction means for reducing CO, which is emitted from the $NO_x$ reduction, to not more than a CO reduction target value. This CO reduction means oxidizes CO emitted from the $NO_x$ reduction means to achieve CO reduction below a CO reduction target value. The CO reduction means of the working example is implemented by a CO oxidation catalyst member 27 that reduces the CO value to about 1/10. CO reduction characteristic by this CO oxidation catalyst member 27 is shown by a curve M of FIG. 4 and a curve N of FIG. 5. CO quantities in the exhaust gas shown by the curve D and the curve E are finally reduced as shown by the curve M and the curve N, respectively.

This CO oxidation catalyst member 27, having such a structure shown in FIG. 7, is formed in the following manner, for example. With a flat plate 28 and a wave plate 29 as base materials, both of which are made of stainless, a multiplicity of minute pits and bumps are formed on their surfaces, and oxidation catalyst is applied on top of the surfaces. Then, the flat plate 28 and the wave plate 29 are cut into a specified elongate shape and laid on each other and spirally rolled into a roll state. This roll is surrounded and fixed by a side plate 30. In this way, the CO oxidation catalyst member 27 as shown in FIG. 7 is formed. Platinum is used as the oxidation catalyst. It is noted that FIG. 7 shows only part of the flat plate 28 and the wave plate 29.

The CO oxidation catalyst member 27, as shown in FIG. 1, is removably fitted to the exhaust gas outlet 16 portion. Size and processing capacity of this CO oxidation catalyst member 27 are designed in consideration of the performance of the oxidation catalyst, the quantity of CO to be oxidized, and the pressure loss occurring when the exhaust gas flows through the CO oxidation catalyst member 27.

Further, the $NO_x$ reduction means, as shown in FIG. 2, includes another CO reduction means. This CO reduction means is a heat-transfer-tube removal space 31 called heat insulating space formed by eliminating some of the heat absorbers. Then, as shown in FIG. 2, part of the heat transfer tubes 2, i.e., four heat transfer tubes 2 in this working example are removed so that the heat-transfer-tube removal space 31 where the combustion gas temperature falls within a range not more than 1400° C. and not less than 900° C. is formed.

The heat-transfer-tube removal space 31 falls generally within the aforementioned temperature range in the high combustion state, while it involves a shorter combustion flame, i.e., a narrower burning reaction zone in the low combustion state so as to no longer fall within the temperature range. Accordingly, the CO oxidation catalyst member 27 and the heat-transfer-tube removal space 31 serve as CO reduction means in the high combustion state, while the heat-transfer-tube removal space 31 does not serve as CO reduction means and the CO oxidation catalyst member 27 serves as CO reduction means in the low combustion state.

Operations and actions of the working example of the above-described constitution are explained below. Burning-reaction ongoing gas derived from the burner 1 is subjected to a $NO_x$ reduction action, i.e., combustion-gas-temperature suppression actions by the first to fourth suppression means, at the same time, and still also subjected to such constant excess-air-ratio control that $O_2$ (%) is held at 5.8 in the high combustion state and at 6.25 in the low combustion state by the excess-air-ratio control means.

By such excess-air-ratio control, the excess air ratio is maintained at a generally constant excess air ratio at all times even with the outside-air temperature varied, so that the value of $NO_x$ generation is suppressed to 10 ppm. That is, as a result of the combustion-gas-temperature suppression action by the $NO_x$ reduction means, the combustion gas temperature is lowered by about 100° C. on an average, compared with the comparative example in which the burning-reaction ongoing gas is not subjected to the actions by the second suppression means and the third suppression means. As a result, the $NO_x$ value in the combustion gas flowing out from the upstream-side heat transfer tubes 2 is suppressed to about 10 ppm as shown by the curve A and curve E of FIGS. 4 and 5, respectively.

Also, by the foregoing excess-air-ratio control, the value of exhaust CO derived from the $NO_x$ reduction means is also controlled to a specified value. The value of exhaust CO in the exhaust gas at the exhaust gas outlet 16 is about 400 ppm in the high combustion state and about 100 ppm in the low combustion state as shown by the characteristic curve B and curve F of FIGS. 4 and 5, respectively.

CO generated in the $NO_x$ reduction shown above is reduced in the following manner. The generated CO is, first, partly oxidized at the heat-transfer-tube removal space 31 in the high combustion state, and scarcely oxidized in the low combustion state, then reaching the exhaust gas outlet 16 as exhaust gas. CO remaining in this exhaust gas is oxidized by the CO oxidation catalyst member 27 so that the CO value is reduced to about 1/10, as shown by the characteristic curve M and curve N of FIGS. 4 and 5.

According to this working example, since the $NO_x$ reduction means is implemented by a combination of the first suppression means to the fourth suppression means, the following working effects are produced. Whereas enhancing the functions of the individual suppression means singly would cause drawbacks of the respective suppression means to matter, combining the four suppression means makes it possible to achieve super $NO_x$ reduction relatively easily without causing the emergence of those drawbacks. In particular, later-described unstable characteristics of the fourth suppression means are alleviated, so that stable super $NO_x$ reduction can be achieved. This will be detailed below.

It is noted that the functional enhancement of the first suppression means (heat-absorber cooling) is the provision of the heat transfer tubes 2 in contact with the burner 1 or the increasing of the heat-transfer-surface density of the heat transfer tubes 2. Due to this functional enhancement, there would occur an increase in pressure loss or an unstable combustion such as oscillating combustion.

Also, the functional enhancement of the second suppression means (exhaust gas recirculation) is to increase the exhaust-gas circulation quantity. Due to this functional enhancement, there would occur an amplification of the unstable characteristics of the second suppression means. That is, the exhaust gas recirculation has a characteristic that the exhaust-gas flow rate or temperature changes with changes in combustion quantity or changes in load. An increase in the exhaust-gas recirculation quantity would cause these unstable characteristics to be amplified, making it impossible to achieve a stable $NO_x$ reduction. Also, due to the functional enhancement of the second suppression means, burning reaction would be suppressed, causing an emission increase of CO and unburned components as well as an increase in thermal loss. Further, increasing the exhaust-gas recirculation quantity would cause the blower load to increase.

Also, the functional enhancement of the third suppression means (water/steam addition) is to increase the quantity of water to be added. Due to this functional enhancement, the quantity of condensations would increase with increasing thermal loss, where, particularly in boilers having a feed water preheater for preheating the water fed to the heat transfer tubes 2 by exhaust gas, there would matter corrosion of the feed water preheater due to the condensations.

Further, the functional enhancement of the fourth suppression means (premixing high excess-air-ratio combustion) is to increase the excess air ratio. Due to this functional enhancement, there would occur a halt of burning reaction and an unstable combustion of the burner 1.

In contrast, according to this embodiment, since the first to fourth suppression means are combined together, the problems that would otherwise emerge upon enhancing the functions of the individual suppression means each singly can be prevented from becoming issues.

Also, according to this working example, the following working effects are produced. Since the excess air ratio can be controlled to a generally constant high excess air ratio by the excess-air-ratio control means, a stable $NO_x$ reduction effect can be obtained even with outside air temperature varied. As a result, the $NO_x$ reduction target value can be met over a wide range of operating points on the day and year bases.

Further, the exhaust CO value from the $NO_x$ reduction means is also controlled to a constant one by the constant constant excess-air-ratio control. As a result, the possibility that the exhaust CO value increases due to changes in excess air ratio beyond the processing capacity of the CO oxidation catalyst member 27 is eliminated, thus producing an effect that a stable CO reduction can be achieved. In particular, for a $NO_x$ reduction means of which the $NO_x$ reduction target value is not more than 10 ppm, involving an abrupt increase of the exhaust CO value at around 10 ppm, the constant excess-air-ratio control produces quite a large effect in terms of the achievement of a CO reduction target value and the facilitation of the capacity design of the CO oxidation catalyst member 27.

The facilitation of the capacity description of the CO oxidation catalyst member 27 is further explained. The CO oxidation catalyst member 27, in which pressure loss increases with increasing capacity, is so designed that the CO reduction target value can be satisfied just at the very limit. Without the constant excess-air-ratio control, there would arise a need for designing the processing capacity of the CO oxidation catalyst member 27 with a margin. Meanwhile, with the processing capacity increased, the pressure loss would increase. As a result, the pressure loss of the steam boiler itself would increase, giving rise to a need for redesigning the blower 4 or the boiler body 3. Performing the constant excess-air-ratio control produces, as in this working example, has an effect of solving these problems.

Further, according to this working example, both the $NO_x$ reduction for reducing the generated $NO_x$ value to not more than 10 ppm as well as the CO reduction can be achieved at the same time, greatly contributing to air pollution control. Besides, in the low combustion state, although the heat-transfer-tube removal space 31 does not function effectively as CO reduction means, yet CO is oxidized by the CO oxidation catalyst member 27, so that CO reduction can be fulfilled regardless of whether it is in the high combustion state or the low combustion state.

It is noted that the present invention is not limited to the above-described working example, and includes the following modified example. Although the heat transfer tubes 2 of the first suppression means are implemented by vertical water tubes in the foregoing working example, yet the heat transfer tubes 2 may also be implemented by water tubes which are positioned horizontal or tilted. Further, the shape of the heat transfer tubes 2 is also not limited to a perfect circle of the foregoing working example, and may be shaped into elliptical or other shapes in another embodiment.

Also, the heat transfer tubes 2 of the first suppression means are provided as bare tubes in the foregoing working example. However, it is also possible that some of the heat transfer tubes 2 in the downstream of the heat-transfer-tube removal space 31 may be fitted with horizontal fillet-like fins or full-peripheral fins (not shown either) so that the heat recovery rate can be enhanced, in another embodiment.

Figure 8:
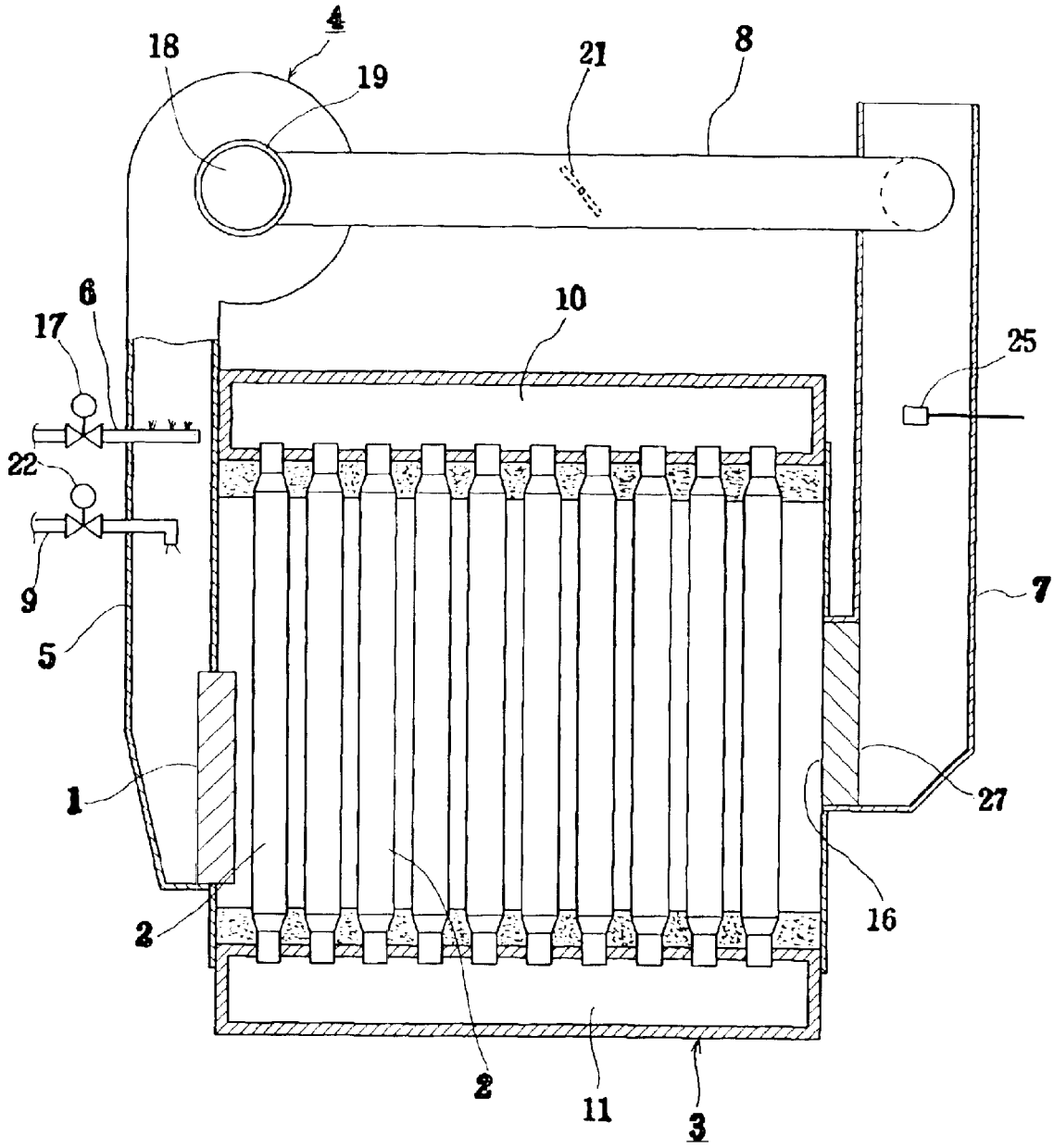
FIG. 8 is an explanatory view of a longitudinal section of another embodiment of the present invention which is equipped with another fourth suppression means.

Also, steam of the steam addition tube 9 of the third suppression means is jetted out into the air inlet passage 19 in the foregoing working example. Otherwise, in another embodiment, the steam addition tube 9 may be attached so as to jet out steam to between the burner 1 and the blower 4 as shown in FIG. 8. According to this modified example, since steam is fed in the downstream of the blower 4, the increase in the blow load of the blower 4 can be lessened as compared with the foregoing working example in which steam is fed on the upstream side, while the blower 4 can be prevented from corrosion due to condensations.

Figure 9:
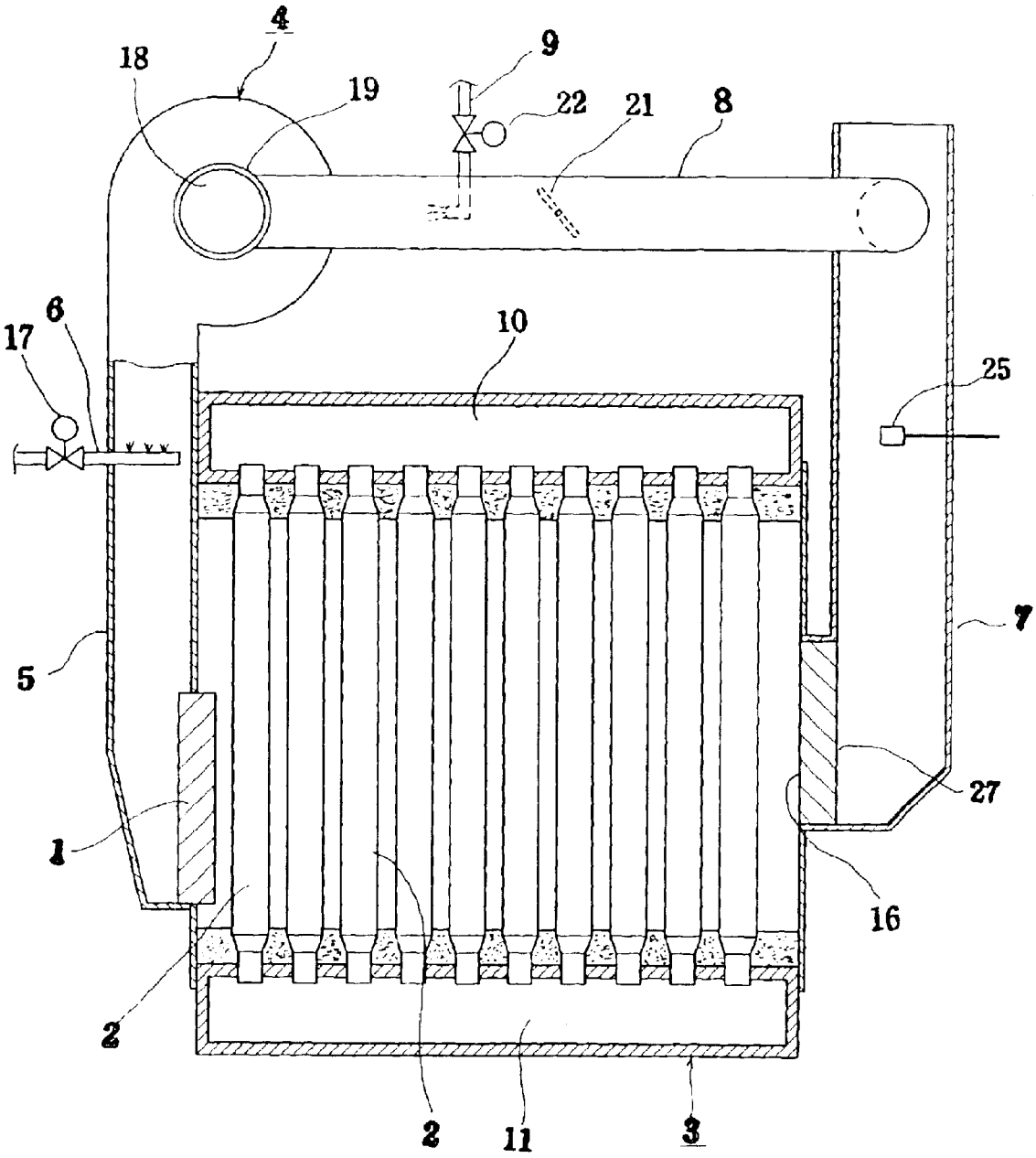
FIG. 9 is an explanatory view of a longitudinal section of another embodiment of the present invention which is equipped with another fourth suppression means.

Also, in another embodiment, the steam addition tube 9 may be attached so as to jet out steam to the exhaust-gas recirculation passage 8 as shown in FIG. 9. Jetting out steam to the exhaust-gas recirculation passage 8 makes condensations less likely to occur, thus producing effects such as less occurrence of rust, uniformized mixing of steam and combustion-use air, and the like.

Also, the fourth suppression means is implemented by a fully-premixing type burner in the foregoing working example. However, it may also be a partly-premixing type burner in another embodiment.

Figure 10:
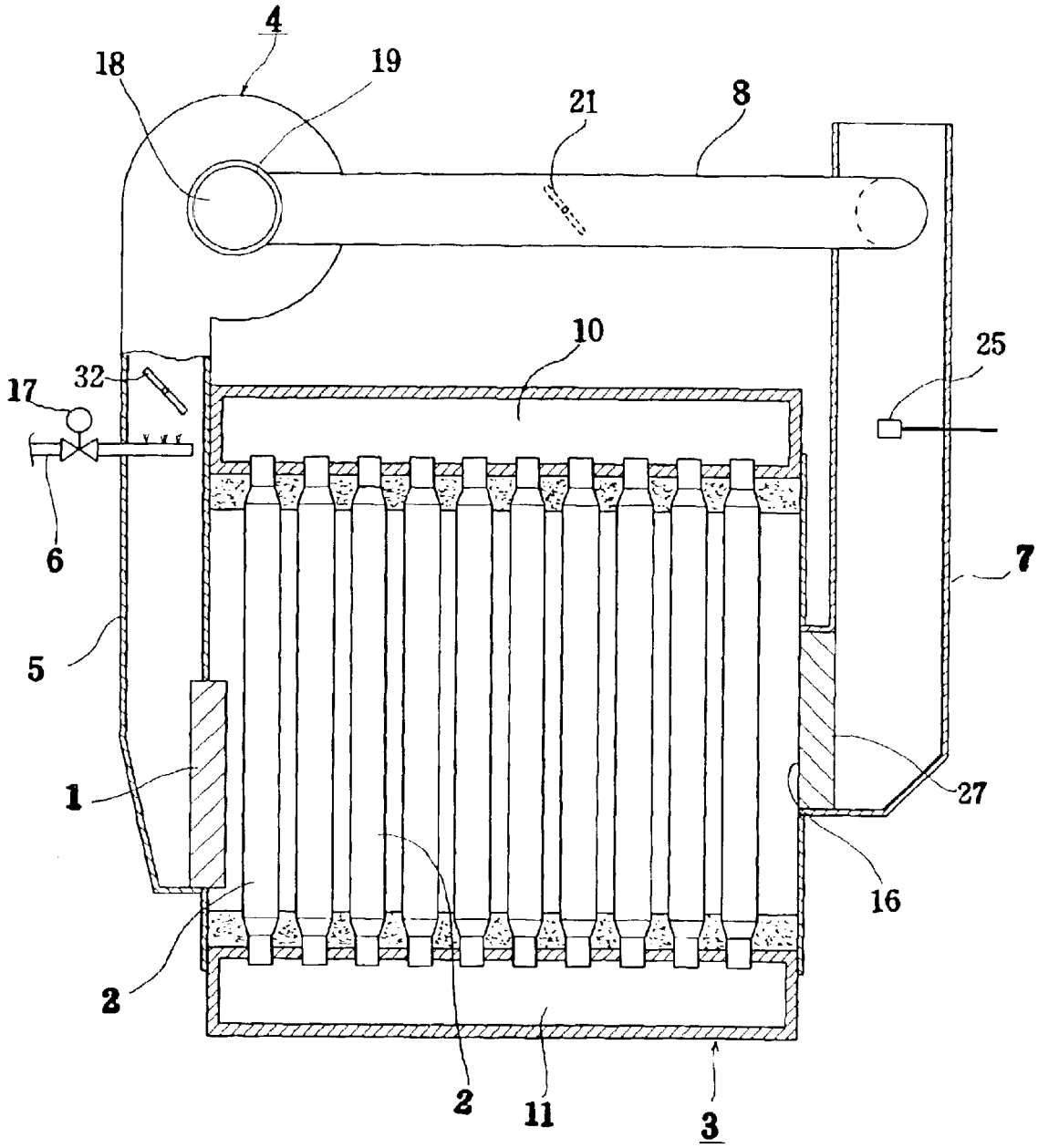
FIG. 10 is an explanatory view of a longitudinal section of another embodiment of the present invention which is equipped with another excess-air-ratio control means.

Also, the excess-air-ratio control means is designed to control the rotational speed of the blower 4 in the foregoing working example. However, it is also possible, in another embodiment, that the excess air ratio is controlled by a second damper 32 as a combustion-air quantity adjusting means provided on the downstream side of the blower 4, as shown in FIG. 10.

Figure 11:
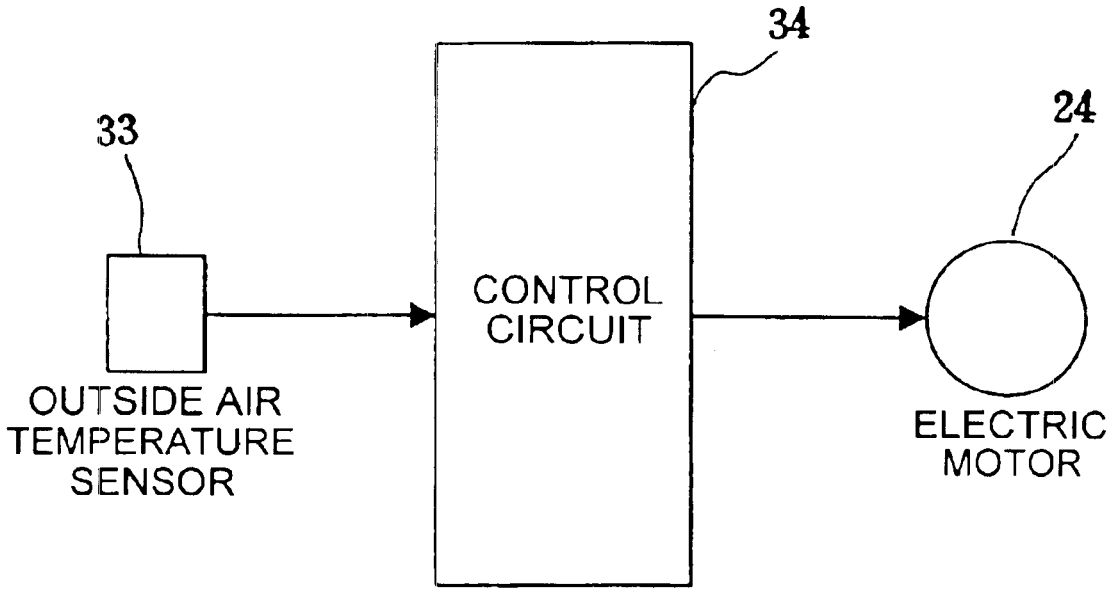
FIG. 11 is a main-part control circuit diagram of another excess-air-ratio control means of another embodiment of the present invention.

Also, the excess-air-ratio control means is controlled by a signal of the oxygen concentration sensor 25 in the foregoing working example. However, in another embodiment, it is also possible that an outside-air temperature sensor 33 as the outside-air temperature detection means for detecting the intake air temperature of the blower 4 is provided, where the excess air ratio is controlled by an output of this outside-air temperature sensor 33 as shown in FIG. 11. In this case, with a specified combustion rate and a specified exhaust-gas recirculation quantity, the relationship between outside-air temperature and excess air ratio is preliminarily determined by experiments, and a correlation table of outside-air temperature versus rotational speed of the blower is prepared. Then, with this correlation table stored in a memory of a control circuit 34 (not shown), the electric motor 24 of the blower 4 may be controlled based on this table so that the excess air ratio is maintained generally constant.

Figure 12:
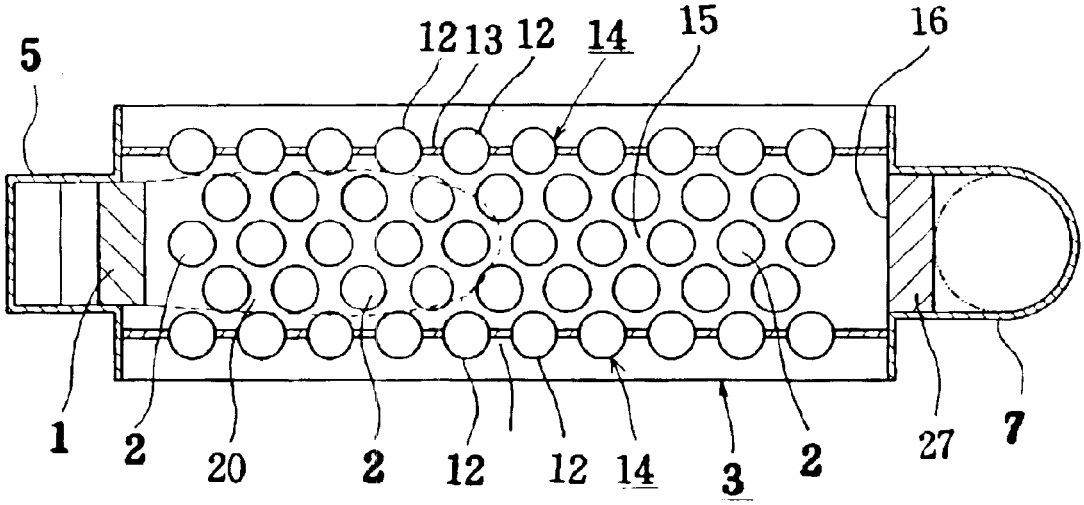
FIG. 12 is a sectional explanatory view of another embodiment of the present invention, corresponding to FIG. 2.

Also, the heat-transfer-tube removal space 31 is included in the $NO_x$ reduction means in the foregoing working example. Otherwise, in another embodiment, it is also possible that the heat-transfer-tube removal space 31 is omitted, i.e., none of the heat transfer tubes are removed, as shown in FIG. 12.

Also, the steam boiler of the foregoing working example is switchable between combustion quantities of high combustion and low combustion. However, the steam boiler may also be a steam boiler without the switching of combustion quantity, in another embodiment.

Further, the CO oxidation catalyst member 27 is attached at the exhaust gas outlet 16 in the foregoing working example. However, in the case where a feed water preheater (economizer) is provided on the exhaust gas passage 7, the CO oxidation catalyst member 27 may also be disposed on the upstream side of the feed water preheater in the chamber in which the feed water preheater is contained.

According to the present invention, there are provided advantages such as the the capability of easily fulfilling such $NO_x$ reduction that the value of generated $NO_x$ falls under 10 ppm, thus the invention being of great industrial value.

What is claimed is:

1. A combustion method for $NO_x$ reduction by controlling temperature of combustion gas derived from a burner, comprising in combination the steps of: suppressing combustion gas temperature by heat absorbers; suppressing combustion gas temperature by recirculating burning-completed gas to a combustion-gas burning reaction zone; and suppressing combustion gas temperature by adding water or steam to combustion-use air of the burner, whereby the combustion gas temperature is suppressed.

2. A combustion method for $NO_x$ reduction as claimed in claim 1, further comprising in combination the step of suppressing combustion gas temperature by burning the burner as a fully-premixing type burner at a high excess air ratio.

3. The method of claim 2 including the additional step of maintaining the high excess air ratio at a substantially constant level independent of an outside air temperature.

4. The method of claim 1 comprising the additional step of providing a blower supplying combustion-use air to the burner and wherein said step of suppressing combustion gas temperature by adding water or steam to combustion-use air of the burner comprises the step of adding water or steam upstream of the blower.

5. The method of claim 1 wherein said step of adding water or steam to combustion-use air of the burner comprises the step of adding water or steam to recirculating burning-completed gas.

6. The method of claim 1 including the additional steps of providing a blower blowing combustion use-air and recirculating burning-completed gas into a burner wherein said step of adding water or steam to combustion-use air of the burner comprises the step of adding water or steam to recirculating burning-completed gas upstream of the blower.

7. The method of claim 1 including in combination the step of suppressing combustion gas temperature by burning the burner as a fully-premixing type burner at high excess air ratio whereby NOx emissions are maintained at a level of 10 ppm or less, at 0% $O_2$ in an exhaust gas, dry basis.

8. The method of claim 1 whereby NOx emissions are maintained at a level of 10 ppm or less, at 0% $O_2$ in an exhaust gas, dry basis.

9. A combustion apparatus for $NO_x$ reduction by controlling temperature of combustion gas derived from a burner, comprising: first suppression means for suppressing combustion gas temperature by heat absorbers provided in a burning reaction zone; second suppression means for suppressing combustion gas temperature by recirculating burning-completed gas to the combustion-gas burning reaction zone; and third suppression means for suppressing combustion gas temperature by adding water or steam to combustion-use air of the burner.

10. A combustion apparatus for $NO_x$ reduction as claimed in claim 9, further comprising, in combination, fourth suppression means for suppressing combustion gas temperature by burning the burner as a fully-premixing type burner at a high excess air ratio.

11. A combustion apparatus for $NO_x$ reduction by controlling temperature of combustion gas derived from a burner having a burning reaction zone and an exhaust gas passage, comprising: heat absorbers provided in the burning reaction zone for suppressing combustion gas temperature; an exhaust gas recirculation passage connected to the exhaust gas passage for recirculating burning-completed gas to an air supply passage, and a line feeding water or steam to the exhaust gas recirculation passage upstream of the burner.

12. The combustion apparatus of claim 11 including a blower providing combustion-use air and recirculating burning-completed gas to the burning reaction zone and wherein said line feeds water or steam into the exhaust gas recirculation passage upstream of said blower.

13. A combustion method for $NO_x$ reduction by controlling temperature of combustion gas derived from a burner, comprising the steps of:

suppressing combustion gas temperature by heat absorbers;

recirculating burning-completed gas to a combustion-gas burning reaction zone;

adding water or steam to combustion-use air of the burner; and burning the burner as a fully-premixing type burner at high excess air ratio;

whereby NOx emissions are maintained at a level of 10 ppm or less, at 0% $O_2$ in an exhaust gas, dry basis.

14. A combustion method comprising the steps of:

burning fuel to produce gasses and exhaust gasses; and maintaining a NOx level in the exhaust gasses at no more that 10 ppm or less, at 0% $O_2$, dry basis;

wherein said step of maintaining a NOx level in the combustion gasses at no more that 10 ppm comprises the steps of:

suppressing combustion gas temperature by heat absorbers;

recirculating burning-completed gas to a combustion-gas burning reaction zone; and adding water or steam to combustion-use air of the burner.

15. The method of claim 14 wherein said step of maintaining a NOx level in the combustion gasses at no more that 10 ppm includes the additional step of burning the burner as a fully-premixing type burner at high excess air ratio.

16. The method of claim 14 wherein said step of adding water or steam to combustion-use air of the burner comprises the steps of adding water or steam to recirculating burning-completed gas and mixing the burning-completed gas with the combustion-use air.

* * * * *